US006354053B1

(12) United States Patent
Kerrels

(10) Patent No.: US 6,354,053 B1
(45) Date of Patent: Mar. 12, 2002

(54) STRUCTURAL JOINT FOR SLABS IN MOLDABLE MATERIAL

(75) Inventor: Pierre Raymond Kerrels, Bousval (BE)

(73) Assignee: Eurosteel S.A., Brussels (BE)

( * ) Notice: Subject to any disclaimer, the term of this patent is extended or adjusted under 35 U.S.C. 154(b) by 0 days.

(21) Appl. No.: 09/446,832

(22) PCT Filed: Apr. 28, 1999

(86) PCT No.: PCT/BE99/00053

§ 371 Date: Dec. 28, 1999

§ 102(e) Date: Dec. 28, 1999

(87) PCT Pub. No.: WO99/55968

PCT Pub. Date: Nov. 4, 1999

(30) Foreign Application Priority Data

Apr. 29, 1998 (BE) ..... 09800322

(51) Int. Cl.[7] ..... E04B 1/63; E04F 15/14

(52) U.S. Cl. ..... 52/396.04; 52/396.02; 52/395; 52/586.1; 52/582.1; 404/47; 404/51; 404/74; 405/287

(58) Field of Search ..... 52/393, 395, 396.02, 52/396.04, 396.08, 402, 582.1, 586.1, 585.1; 404/47, 74, 51; 405/287

(56) References Cited

U.S. PATENT DOCUMENTS

| | | | | |
|---|---|---|---|---|
| 3,640,039 A | * | 2/1972 | McKee et al. | 52/281 |
| 4,453,360 A | * | 6/1984 | Barenberg | 52/396 |
| 5,044,835 A | * | 9/1991 | Fukushima et al. | 405/287 |

FOREIGN PATENT DOCUMENTS

| | | |
|---|---|---|
| DE | 3320034 | 1/1984 |
| DE | 9409387 | 10/1994 |
| NL | 282645 | 12/1964 |

* cited by examiner

*Primary Examiner*—Carl D. Friedman
*Assistant Examiner*—Yvonne M. Horton
(74) *Attorney, Agent, or Firm*—Hovey, Williams, Timmons & Collins

(57) ABSTRACT

The joint includes at least two profile elements having such a shape as to enable mutual engagement thereof as a male part and at least a female part, each being integral with one of the edges of two adjacent slabs. One edge of the slab is provided with a substantially L-shaped female profile, whose vertical stem extends all along the edge up to the sharp edge of the upper surface of the slab, and whose base stem extends towards the inner part of the slab and is downwardly folded to form a further stem, extending parallel to the base stem and forming a small space therebetween, for possible engagement of a part of the male profile.

9 Claims, 3 Drawing Sheets

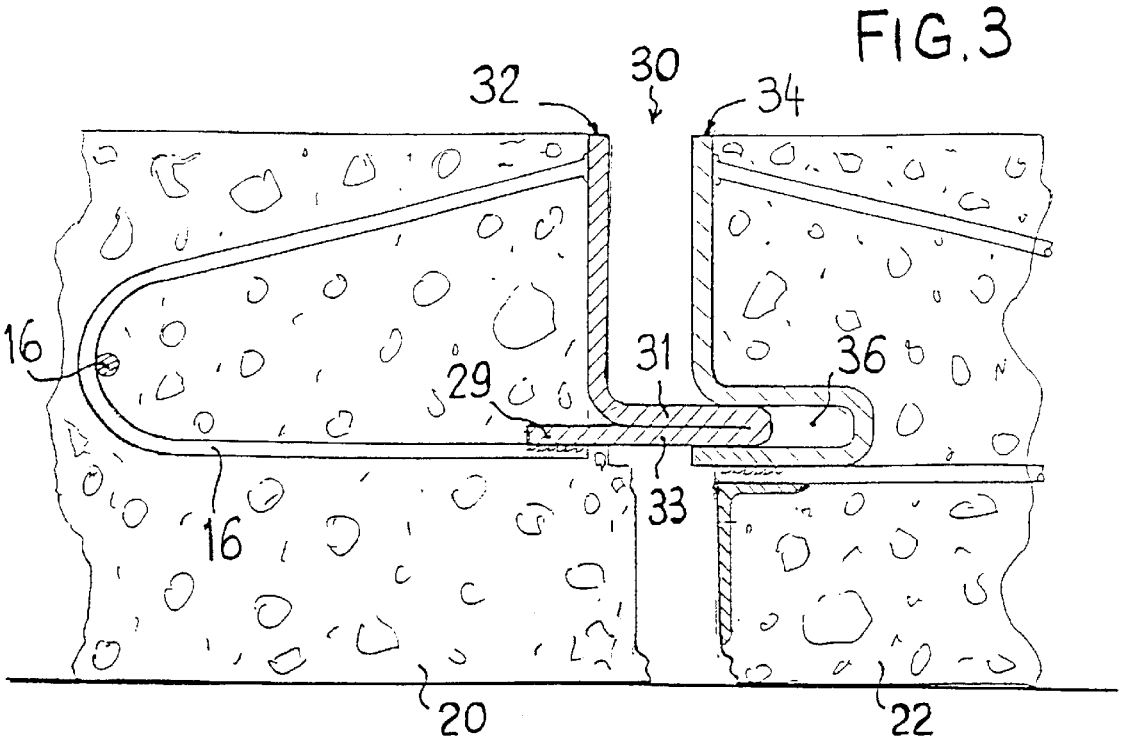
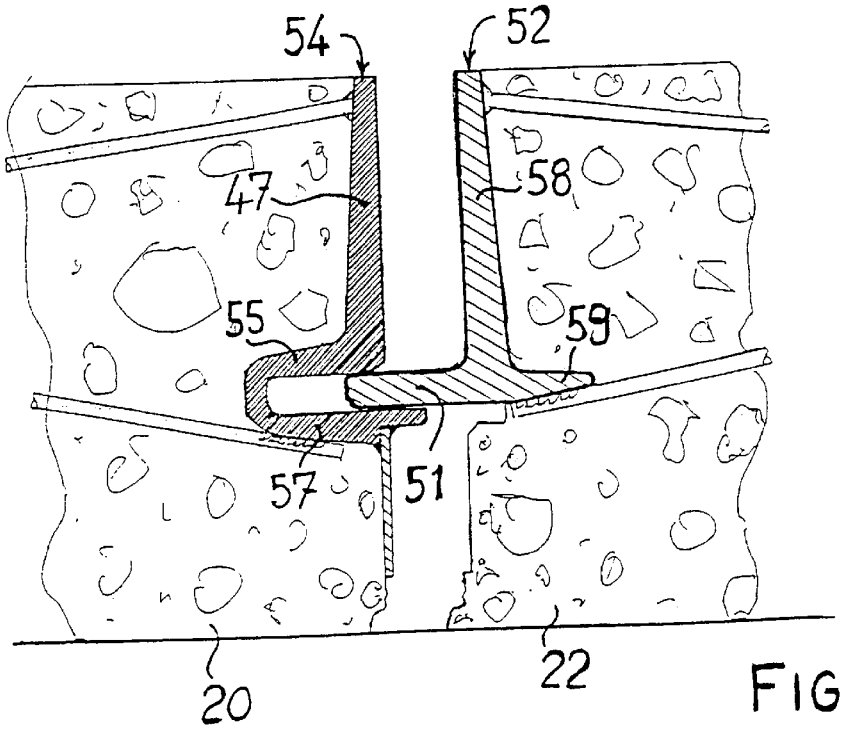
FIG. 4

FIG. 5
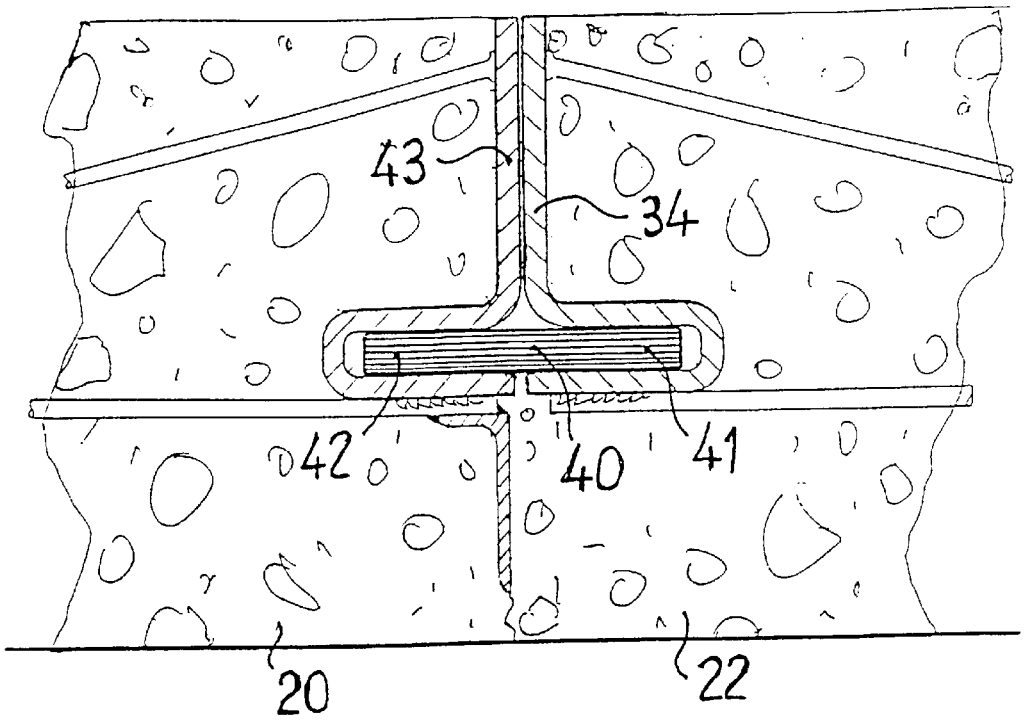
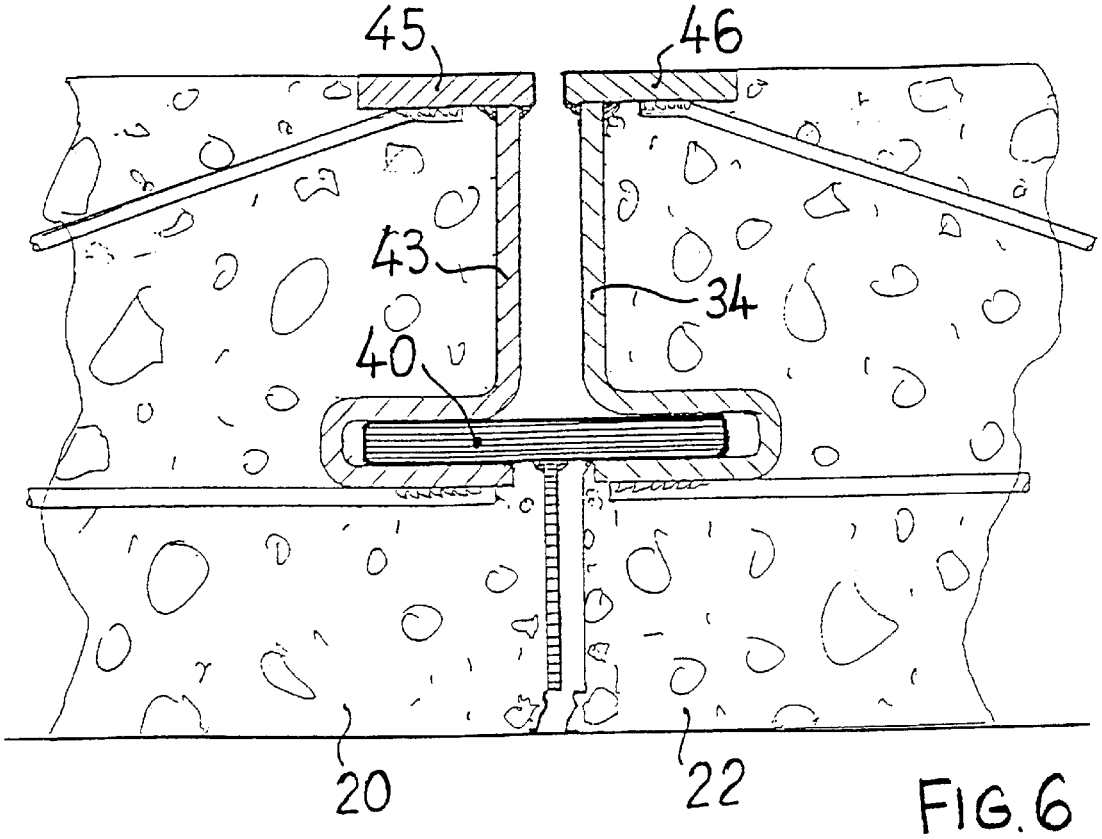
FIG. 6

STRUCTURAL JOINT FOR SLABS IN MOLDABLE MATERIAL

TECHNICAL FIELD

The present invention relates to a structural joint for slabs made of a moldable material, particularly for slabs made of a material having a hydraulic binding agent, such as concrete.

BACKGROUND OF THE INVENTION

When large concrete surfaces are to be made, it is recommended to divide the surfaces into concrete slabs of a given size. Advantages are obtained from providing, between these slabs, on the edges thereof, metal elements named structural joints allowing, on the one hand, thermal contraction or expansion as well as correction of dimension or angle variations, and on the other hand reinforcement of the edges of the moldable material with a hydraulic or non-hydraulic bonding agent, e.g. concrete slabs.

Currently, concrete slabs are commonly reinforced by joints made from sheet steel profiles.

Several different types of metal joints have been proposed to provide a reinforcing effect on the composite material at joint areas. This reinforcing effect essentially depends on the geometric and mechanical properties of the selected joints.

In order that different types of structural joints can be compared, it may be of use to recall the behavior and the process for reinforcement of the sharp edge of a composite fragile matrix material.

This behavior depends on the reinforcing effect on the matrix near the sharp edges submitted to scratching and shearing stress.

Reinforcement at the ends of the slabs should ideally meet the following requirements:

adequate protection of the sharp edge, effective anchorage to prevent detachment, a mortise and tenon system, the need to provide sufficient thickness, to prevent slabs from being sheared at weak points, determined by the geometric design of the metal profile.

SUMMARY OF THE INVENTION

Therefore, the invention relates to a structural joint, for example made of steel, for reinforcement of the sharp edges of a matrix or slab material, e.g. concrete, which never comes loose therefrom, neither due to the joint, nor to matrix embrittlement at the anchorage area.

To this end, the reinforcement joint comprises a male and female jointing system downwardly offset from the median line of the slab, so that a greater thickness of the matrix can be obtained above the jointing system to provide higher resistance to external stress loading.

Joints of the double-profile type having a male/U-shaped female mortise and tenon system and opposing relative vertical displacements of the two half-slabs are already known in the art.

Profiles are integral with concrete slabs, by being anchored thereto by reinforced concrete rods welded on profiles.

A common structural joint is obtained from a substantially omega-shaped double profile, with the outer contour of the one fitting the inner contour of the other. The male central part of the joint must have a sufficient volume to allow it to be filled with the moldable material.

When the slab has an even thickness and the upper part of the joint has to be thickened to reach important load capacities, the lower part of the joint becomes insufficient, wherefore this lower part will no longer stand said loads due to an insufficient thickness of the matrix.

Hence, the need arises to have a number of joint models having different heights.

Another problem encountered with such profiles consists in that, when the concrete slab has a reduced height, the minimum size of the omega-shaped profile is still considerable due to the volume required for the male central part of the joint.

As a result, the concrete mass in the upper part of the slab edge, above the profile jointing system, is widely insufficient to stand normal loads on the slab surface and, consequently, this part is exposed to deterioration caused by concrete cracking or scratching.

The object of the present invention is to obviate the above drawbacks through simple and effective means, which will be described in detail below.

To that effect, the structural joint in accordance with the invention has the characteristics as specified in the claims at the end of the disclosure.

BRIEF DESCRIPTION OF THE DRAWINGS

For a better understanding of the invention, an exemplary prior art structural joint, as well as several variant embodiments of the joint will be described below with the help of the annexed drawings, in which:

FIG. 3: is the same view as FIG. 2, with the joint being in the retracted position;

FIG. 4: is a cross sectional view of a structural joint according to the invention made by using hot rolled profiles;

FIGS. 5 and 6: are variant embodiments of the structural joint according to the invention.

DETAILED DESCRIPTION OF THE EMBODIMENTS

Figure 1:
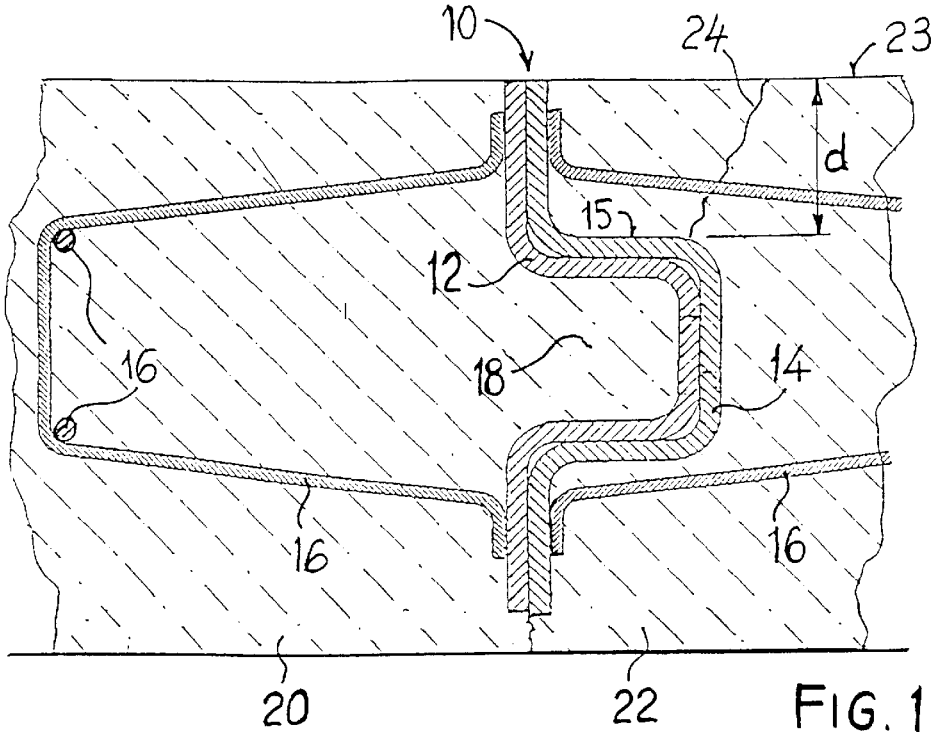
FIG. 1: is a cross sectional view of a structural joint made by using prior art profiles.

FIG. 1 shows a prior art structural joint 10, comprising two metal profiles disposed along the adjacent edges of two concrete slabs 20, 22.

The joint 10 consists of a profile forming a male part 12, anchored in the edge of the slab 20, and of a profile forming a female part 14, anchored in the edge of the slab 22.

The male and female parts 12, 14 of the profiles have upwardly and downwardly extending wings to fit the sharp edge of the upper surface and the sharp edge of the lower surface of the concrete slabs 20, 22 respectively.

Profiles 12 and 14 are typically anchored by reinforced concrete rods 16 arranged all along said profiles.

As is apparent, the male part 12 of the profile has a cavity 18 which has to be filled with moldable material such as concrete and which cannot be reduced in size because if it were, it would be difficult for concrete to penetrate therein.

Further, the distance "d" between the upper side 15 of the female profile 14 and the surface 23 of the concrete slab 22 is very small, resulting in a real risk of cracking and scratching along a break line 24.

Figure 2:
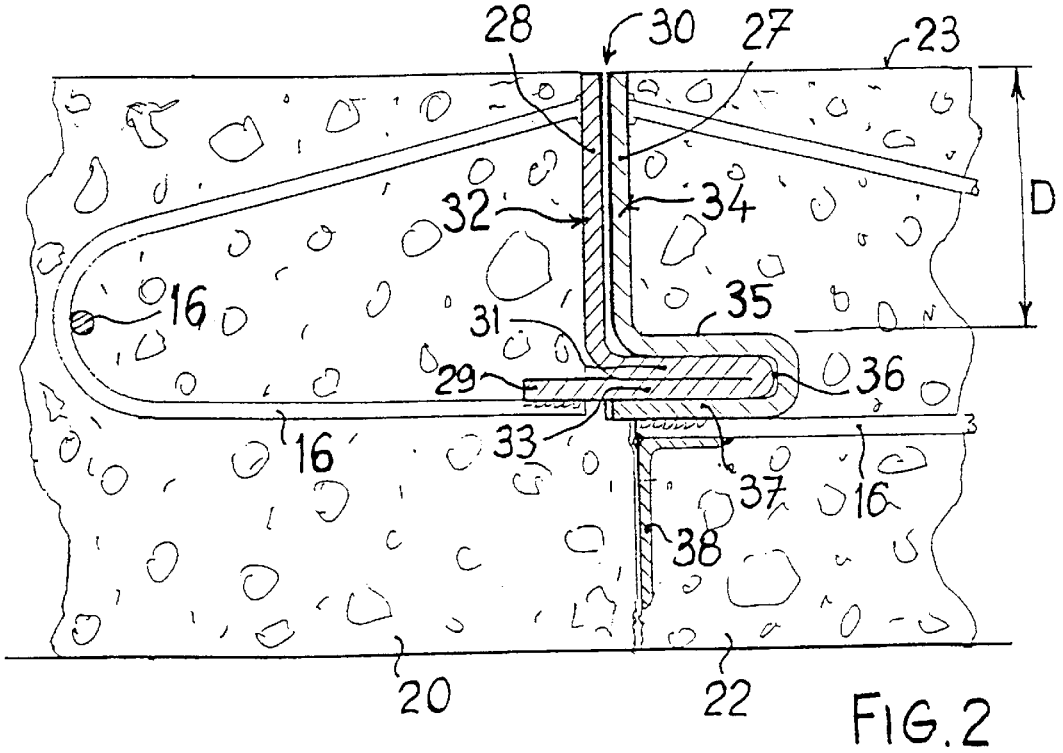
FIG. 2: is a cross sectional view of a structural joint in accordance with the invention, in the closed position.

One embodiment of the joint according to the invention is shown in FIG. 2.

In this embodiment, the structural joint 30 consists of two specially shaped profiles fitting one into the other as a mortise and tenon system.

The male part consists of a substantially L-shaped sheet, whereof the vertical stem extends up to the sharp edge of the upper surface of the slab 20 and the male base stem 31 is downwardly folded in such a manner as to form a second lower branch 33 near a first upper branch 60 and whose end may extend beyond the vertical stem to form a shoulder 29 designed for anchorage in the concrete.

The female part 34 of the joint 30 also consists of a substantially L-shaped sheet, whereof the vertical stem extends up to the edge of the upper surface of the slab 22 and the base stem 35 is downwardly folded in such a manner as to form a form lower branch 37 parallel to an upper branch 62, forming a space 36 therebetween for possible engagement of the folded branches 60, 33 of the male profile 32.

As is apparent, the distance "D" from the base stem 35 of the female profile 34 to the surface 23 of the concrete slab 22 is much greater than that of FIG. 1, and the concrete mass may easily stand important loads along the edge of the concrete slab 22.

Typically, there may be also provided a profiled section in the form of an angle 38, fastened to the lower part 37 of the female profile 34, which may act as a spacer when the slab is cast.

This angle sheet 38 preferably extends up to the sharp edge of the lower surface of the concrete slab 22.

FIG. 4 shows an equivalent embodiment according to the invention.

Here, profiles are hot rolled and the female part 54 has a symmetric L shape integral with the edge of the concrete slab 20 and whose vertical stem 47 extends up to the sharp edge of the upper surface of this slab. The base stem 55 extends towards the inner part of the slab and is downwardly folded to form a further stem 57 which extends parallel to the base stem 55 forming a small space 56 therebetween.

The male part 52 also has a symmetrical L shape and is integral with the edge of the concrete slab 22.

The vertical stem 58 extends up to the sharp edge of the upper surface of the slab and the base stem 51 extends out of the edge of the slab 22, being provided with a shoulder 59 extending towards the inner part of the slab 22.

As shown in FIGS. 5 and 6, which are two variant embodiments of the invention, the edge of one of the slabs 22 is made integral with a female profile 34 like in FIG. 2.

However, in this embodiment, the edge of the other slab 20 is made integral with a second female profile 43, disposed symmetrically to the first female profile 34.

In this case, the male part consists of a separate flat part 40, whereof one end 41 may be engaged in the first female profile 34 and the other end 42 may be engaged in the second female profile 43.

In FIG. 6, the upper ends of the female profiles 34 and 43 have longitudinal members 45 and 46 forming upper edges of the two adjacent concrete slabs.

Thanks to the invention, a structural joint is obtained which is composed of profiles whose male/female part is considerably compact as compared with existing joints.

As a result, wide movements are allowed in the horizontal plane and resistance to important loads is provided, with no excessive slack at the joint.

Thanks to the new profile of the structural joint according to the invention, no problems are encountered in filling the central part of the male part.

The upper and lower parts of the slab edge, which are situated on both sides of the male/female part of the joint and are to be filled with the moldable material, are thickened and ensure the best shear resistance.

Hence, the new profile can be used in a variety of different thicknesses of the slab or matrix.

In thin slabs, the male/female jointing part may be downwardly offset from the median line of the slab, allowing greater matrix thicknesses at the fragile locations thereof, and ensuring this function both in the open and closed position of the joint.

This offset is obtained thanks to the small size of the male part of the jointing system, consisting of a compact and rigid metal or non-metal member which provides the jointing system with considerable resistance.

Since the male part is massive, the invention obviates any problem for filling it, and its size reduction is advantageous for the upper and lower matrix sections, ensuring the best possible resistance of the slab edges.

Obviously, the embodiments of the invention are described and illustrated by way of example, and other variant embodiments might be provided without departure from the scope of the invention.

What is claimed is:

1. A structural joint adapted to be engaged with slabs made of a moldable material comprising at least two profile elements, each adapted to be integral with one of the edges of two adjacent slabs, the profile elements being arranged so as that one may engage the other, one of the profile elements comprising a male profile, at least one of the profile elements being a female profile, whereby, the female profile being a substantially L-shaped female profile adapted to be engaged with at least one edge of one of the slabs and having a vertical stem adapted for extending all along the edge up to a sharp edge of an upper surface of the slab, and having a base stem adapted for extending toward the inner part of the slab, wherein the base stem includes a first branch and is downwardly folded to form a second branch extending substantially parallel to the first branch of the base stem and forming a small space therebetween to permit receipt of a part of the male profile into the space in shiftable engagement therewith for permitting relative movement between the male profile and the female profile.

2. A structural joint as claimed in claim 1, whereby the other edge of the slab is provided with a substantially L-shaped male profile, having a vertical stem extending all along the edge up to the sharp edge of the upper surface of the slab, and having a base stem extending out of the slab and has such a size that it engaged in the small space of the female profile.

3. A structural joint as claimed in claim 2, whereby the base stem of the male profile is provided with an extension in the form of a shoulder which extends beyond the vertical stem and is directed toward the inner part of the slab.

4. A structural joint as claimed in claim 1, whereby the other edge of the slab is provided with a second female profile disposed symmetrically to the first female profile and in that the male profile consists of a flat part having one end and another end whereof said one end is engaged in the first female profile and the other end is engaged in the second female profile.

5. A structural joint as claimed in claim 1, whereby the base stem of the female profile is situated in a downwardly offset position with respect to the median line of the concrete slab.

6. A structural joint as claimed in claim 1, whereby the male profile comprises a compact and rigid metal part, which can interact with at least one female profile ensuring a high resistance of the jointing system.

7. A structural joint as claimed in claim 1, wherein the vertical stem of the female profile is oriented in a substantially vertical plane and the first branch of the base stem is oriented in a substantially horizontal plane.

8. A structural joint as claimed in claim 7, wherein the second branch of the base stem is oriented in a substantially horizontal plane.

9. A structural joint as claimed in claim 1, wherein said part of the male profile is oriented in a substantially horizontal plane for interfitting into the space.

* * * * *